US010497314B2

(12) United States Patent
Chen et al.

(10) Patent No.: US 10,497,314 B2
(45) **Date of Patent: *Dec. 3, 2019**

(54) DRIVING METHOD AND DRIVING DEVICE FOR IMPROVING CONTRAST OF OLED IMAGE

(71) Applicant: Shenzhen China Star Optoelectronics Technology Co., Ltd., Shenzhen (CN)

(72) Inventors: Xiaolong Chen, Shenzhen (CN); Chih Hao Wu, Shenzhen (CN); Ming Jong Jou, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 197 days.

This patent is subject to a terminal disclaimer.

(21) Appl. No.: 15/327,306

(22) PCT Filed: Dec. 21, 2016

(86) PCT No.: PCT/CN2016/111341

§ 371 (c)(1),
(2) Date: Sep. 14, 2017

(87) PCT Pub. No.: WO2018/040402

PCT Pub. Date: Mar. 8, 2018

(65) Prior Publication Data

US 2019/0213955 A1 Jul. 11, 2019

(30) Foreign Application Priority Data

Aug. 31, 2016 (CN) ..... 2016 1 0796910

(51) Int. Cl.
*G09G 3/3258* (2016.01)
*G09G 3/3225* (2016.01)
*G09G 3/20* (2006.01)

(52) U.S. Cl.
CPC ..... *G09G 3/3258* (2013.01); *G09G 3/2003* (2013.01); *G09G 3/3225* (2013.01);
(Continued)

(58) Field of Classification Search
CPC ..... G09G 3/3258; G09G 3/2003; G09G 2320/066; G09G 2320/0233;
(Continued)

(56) References Cited

U.S. PATENT DOCUMENTS 7,859,492 B2 * 12/2010 Kohno ..... G09G 3/3225 345/77
8,947,470 B2 * 2/2015 Jang ..... G09G 3/3426 345/12

(Continued)

*Primary Examiner* — Tom V Sheng

(57) ABSTRACT

Disclosed are a driving method and a driving device for improving a contrast of an OLED image. The driving method includes steps of dividing an OLED display panel into a plurality of partitions, calculating an average pixel level of one frame of image to be displayed corresponding to each partition, determining, based on the average pixel level, a preset value of a discharge reference voltage, and regulating the discharge reference voltage applied to pixel driving circuits in the partition to the preset value. The driving method can significantly improve the contrast of the OLED image during display.

10 Claims, 5 Drawing Sheets

(52) U.S. Cl.
CPC ..... *G09G 2310/0221* (2013.01); *G09G 2310/0251* (2013.01); *G09G 2320/0233* (2013.01); *G09G 2320/066* (2013.01); *G09G 2330/021* (2013.01); *G09G 2330/028* (2013.01); *G09G 2360/16* (2013.01)

(58) Field of Classification Search
CPC ..... G09G 2330/021; G09G 2360/16; G09G 3/3225; G09G 2310/0221; G09G 2310/0251; G09G 2330/028
See application file for complete search history.

(56) References Cited

U.S. PATENT DOCUMENTS

| | | | | |
|---|---|---|---|---|
| 9,159,272 | B2 * | 10/2015 | Murai | G09G 3/3426 |
| 9,881,553 | B2 * | 1/2018 | Chen | G09G 3/3258 |
| 10,049,643 | B1 * | 8/2018 | Wu | G09G 5/02 |
| 2015/0130851 | A1 * | 5/2015 | Jeong | G09G 3/20 345/690 |
| 2015/0243213 | A1 * | 8/2015 | Ryu | G09G 3/3225 345/212 |

* cited by examiner

DRIVING METHOD AND DRIVING DEVICE FOR IMPROVING CONTRAST OF OLED IMAGE

CROSS-REFERENCE TO RELATED APPLICATIONS

This application claims the priority of Chinese patent application CN201610796910.4, entitled "Driving Method and Driving Device for Improving Contrast of OLED Image" and filed on Aug. 31, 2016, the entirety of which is incorporated herein by reference.

FIELD OF THE INVENTION

The present disclosure relates to the field of OLED display, and in particular, to a driving method and a driving device for improving a contrast of an OLED image.

BACKGROUND OF THE INVENTION

OLED (Organic Light-Emitting Diode) display device has the characteristic of auto-luminescence, and no backlight is needed. Therefore, the screen of the OLED display device can be made very thin and light, and is especially suitable for portable mobile products. At the same time, the OLED display device further has the advantages of a wide viewing angle, low power consumption, a fast response and so on, and thus the OLED display device is more and more widely used.

The drive technology of OLED is different from that of the existing liquid crystal display product. The liquid crystal display device is a voltage control device, while OLED is a current control device. With respect to an OLED display panel, a best display effect can be obtained only when accurate current and unified control are provided to a control circuit corresponding to the OLED display panel. However, the control circuit is generally composed of non-linear components, and it is difficult to achieve accurate current and unified control. On this basis, it is more difficult to improve the display performance of other aspects of the OLED.

The OLED is a self-luminous device, and the degradation degrees of material of each of the luminescent points constituting the OLED display device are different, and thus the OLED display device will have luminance difference during display. How to increase a contrast of an OLED display image so as to improve a quality of the OLED display image becomes an urgent problem to be solved. The present disclosure provides a solution to the above problem.

SUMMARY OF THE INVENTION

One of the technical problems to be solved by the present disclosure is to provide a solution for increasing a contrast of an OLED display image so as to improve a quality of the OLED display image.

In order to solve the above technical problem, embodiments of the present disclosure first provide a driving method for improving a contrast of an OLED image. The method comprises steps of: dividing an OLED display panel into a plurality of partitions; calculating, based on the partitions, an average pixel level of one frame of image to be displayed corresponding to each partition, wherein the average pixel level is an average value of gray scale values of pixel units in one partition; determining, based on the average pixel level, a preset value of a discharge reference voltage corresponding to each partition and applied to each pixel driving circuit in the partition; and regulating the discharge reference voltage applied to pixel driving circuits in the partition to the preset value.

Preferably, after the step of determining, based on the average pixel level, a preset value of a discharge reference voltage corresponding to each partition and applied to each pixel driving circuit in the partition, the driving method further comprises a step of re-determining a preset value of the discharge reference voltage using a voltage compensation algorithm, specifically:

when a difference between preset values of discharge reference voltages of adjacent partitions determined according to the average pixel level is larger than a voltage threshold, reducing a higher preset value of the discharge reference voltage, and/or increasing a lower preset value of the discharge reference voltage.

Preferably, after the step of calculating, based on the partitions, an average pixel level of one frame of image to be displayed corresponding to each partition, the driving method further comprises a step of re-calculating the average pixel level using an image compensation algorithm:

comparing a difference between average pixel levels of any two partitions, when the difference is less than or equal to a first pixel level threshold, selecting pixel units with a lower gray scale value according to a first number of pixels, and respectively decreasing a gray scale value of each pixel unit; and selecting pixel units with a higher gray scale value according to a second number of pixels, and respectively increasing a gray scale value of each pixel unit.

Preferably, the step of re-calculating the average pixel level using an image compensation algorithm further comprises:

comparing a difference between average pixel levels of two adjacent partitions, when the difference is larger than a second pixel level threshold, decreasing a gray scale value of a pixel unit with a higher gray scale value at an edge of the two adjacent partitions; and/or increasing a gray scale value of a pixel unit with a lower gray scale value at the edge of the two adjacent partitions.

Preferably, the discharge reference voltage applied to pixel driving circuits in the partition is regulated to the preset value before switching from a display image of a current frame to the one frame of image to be displayed.

Preferably, the step of dividing an OLED display panel into a plurality of partitions comprises:

dividing the OLED display panel evenly into m*n partitions along a direction parallel to rows of the pixel units and a direction parallel to columns of the pixel units, wherein m and n are both natural numbers.

The embodiment of the present disclosure further provides a driving device for improving a contrast of an OLED image, which comprises:

a dividing module, configured to divide an OLED display panel into a plurality of partitions;

a pixel level calculation module, configured to calculate, based on the partitions, an average pixel level of one frame of image to be displayed corresponding to each partition, wherein the average pixel level is an average value of gray scale values of pixel units in one partition;

a reference voltage determination module, configured to determine, based on the average pixel level, a preset value of a discharge reference voltage corresponding to each partition and applied to each pixel driving circuit in the partition; and a regulation module, configured to regulate the discharge reference voltage applied to pixel driving circuits in the partition to the preset value.

Preferably, the driving device further comprises a voltage compensation module which is configured to, after the reference voltage determination module determines a preset value of a discharge reference voltage corresponding to each partition and applied to each pixel driving circuit in the partition, re-determine a preset value of the discharge reference voltage using a voltage compensation algorithm:

the voltage compensation module is specifically configured to, when a difference between preset values of discharge reference voltages of adjacent partitions determined according to the average pixel level is larger than a voltage threshold, reduce a higher preset value of the discharge reference voltage, and/or increase a lower preset value of the discharge reference voltage.

Preferably, the driving device further comprises an image compensation module which is configured to compare a difference between average pixel levels of any two partitions:

when the difference is less than or equal to a first pixel level threshold, selecting pixel units with a lower gray scale value according to a first number of pixels, and respectively decreasing a gray scale value of each pixel unit; and selecting pixel units with a higher gray scale value according to a second number of pixels, and respectively increasing a gray scale value of each pixel unit.

Preferably, the image compensation module compares a difference between average pixel levels of two adjacent partitions:

when the difference is larger than a second pixel level threshold, decreasing a gray scale value of a pixel unit with a higher gray scale value at an edge of the two adjacent partitions; and/or increasing a gray scale value of a pixel unit with a lower gray scale value at the edge of the two adjacent partitions.

Compared with the prior art, one embodiment or more embodiments in the above solution can have the following advantages or beneficial effects.

Through dividing the OLED display panel into different partitions, one frame of image can have a plurality of different discharge reference voltages (Vrefs) which are independent from one another during display. In this manner, the contrast of the OLED can be significantly improved during display, and an image quality can be improved accordingly.

Other advantages, objects and features of the present disclosure will be illustrated in the following description, and to some extent, will be obvious to those skilled in the art based on the study of the following, or can be taught from the practice of the present disclosure. The objects and other advantages of the present disclosure can be achieved and obtained by the structures particularly pointed out in the following description, claims, and accompanying drawings.

BRIEF DESCRIPTION OF THE DRAWINGS

The accompanying drawings are used to provide a further understanding of the technical solution of the present disclosure or the prior art, and constitute a part of the description, wherein the accompanying drawings illustrating the embodiments of the present disclosure are used to explain the technical solution of the present disclosure in conjunction with the embodiments of the present disclosure, but do not constitute a limitation on the technical solution of the present disclosure.

DETAILED DESCRIPTION OF THE EMBODIMENTS

The implementation mode of the present disclosure will be described in detail below with reference to the accompanying drawings and embodiments, by means of which, the implementation process regarding how the present disclosure uses technical means to solve the technical problem and achieve the corresponding technical effect can be fully understood and implemented accordingly. The embodiments of the present disclosure and respective features in the embodiments can be combined with each other under the condition of no conflict, and the formed technical solutions are all within the protection scope of the present disclosure.

Figure 1:
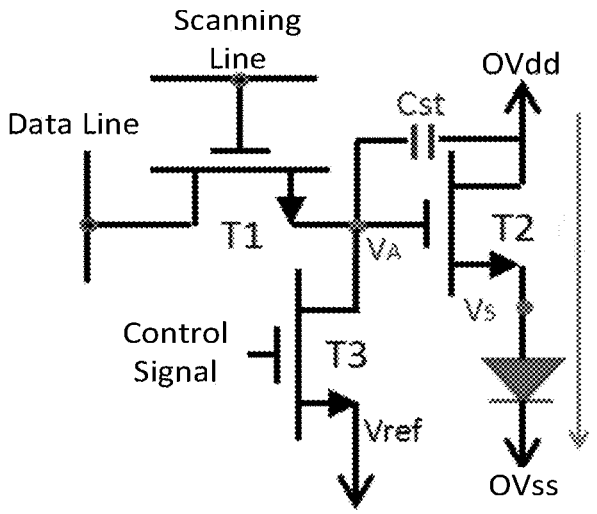
Fig. 1 (Prior Art)
FIG. 1 is a structural diagram of a 3T1C pixel driving circuit of OLED in the prior art.

FIG. 1 is a structural diagram of a 3T1C (3 transistors 1 capacitor) pixel driving circuit of OLED in the prior art. As shown in FIG. 1, the driving circuit is composed of thin film transistors T1, T2, T3, a capacitor Cst and an organic light emitting diode. A gate of the transistor T1 is connected to a scanning line and a source thereof is connected to a data line. The transistor T1 is turned on or turned off according to received scanning signals and data signals, and the storage capacitor Cst is charged by T1. A drain of the transistor T1 is connected to a gate of the transistor T2. A voltage of the storage capacitor Cst can control a gate potential $V_A$ of the transistor T2 so as to turn on or turn off the transistor T2.

The transistor T3 can achieve a discharge effect. A source of the transistor T3 is also coupled to the gate of the transistor T2, and a drain thereof is connected to a fixed voltage Vref for reference. A gate of the transistor T3 receives a control signal, and under an action of the signal, the transistor T3 is turned on so that the storage capacitor Cst is discharged via the transistor T3. The gate potential $V_A$ of the transistor T2 changes, and when the voltage is stable, $V_A$ is about Vref. That is, a discharge effect of OLED can be realized.

An I-V equation of a transistor is shown in expression (1):

$$I_{ds,sat}=k\cdot(V_{GS}-V_{th,T2})^2=k\cdot(V_A-V_S-V_{th,T2})^2 \quad (1),$$

wherein k is an intrinsic conduction factor and $V_{th,T2}$ is a turn-on voltage of the transistor T2.

As can be seen from the above expression, a value of $I_{ds,\ sat}$ is related to $V_A$, while $V_A$ is related to the reference voltage Vref. Therefore, it is possible to control the value of $V_A$ after discharge by controlling the value of Vref.

Further, a pixel unit charging time can be controlled through controlling a time when T1 and T3 are turned on. Since a human eye's perception of luminance is an integral of time, it is possible to use digital voltages (i.e., two Gamma voltages) to display different gray scale luminance images. That is, PWM (Pulse-Width Modulation) driving method has been used in the prior art.

Based on the above-described pixel driving circuit, the present disclosure provides a driving method for improving a contrast of an OLED display image, which will be illustrated below with reference to the embodiments.

Figure 2:
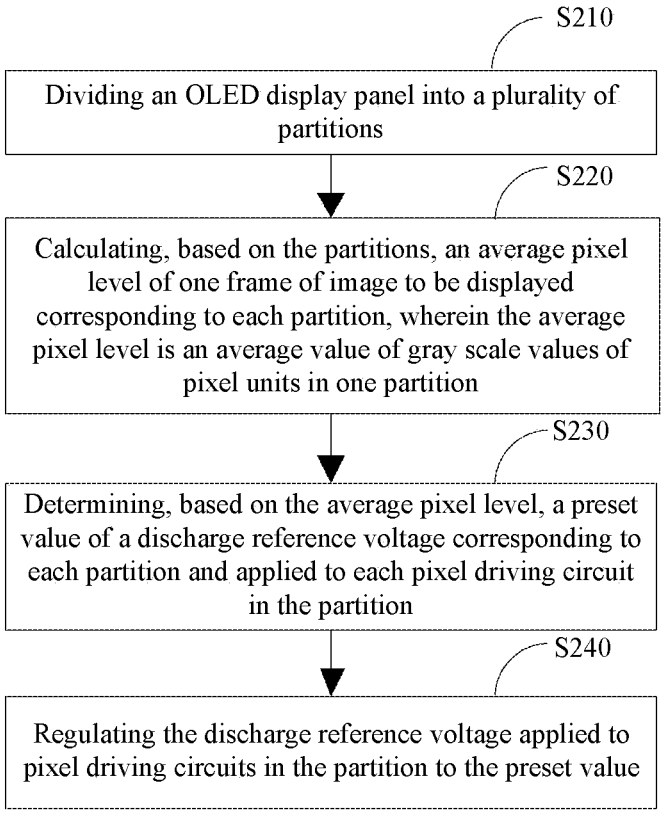
FIG. 2 is a flow chart of a driving method for improving a contrast of an OLED image according to one embodiment of the present disclosure.

FIG. 2 is a flow chart of a driving method for improving a contrast of an OLED image according to one embodiment of the present disclosure. As shown in FIG. 2, the method comprises the following steps.

In step S210, an OLED display panel is divided into a plurality of partitions.

In step S220, an average pixel level of one frame of image to be displayed corresponding to each partition is calculated based on the partitions.

In step S230, a preset value of a discharge reference voltage corresponding to each partition and applied to each pixel driving circuit in the partition is determined based on the average pixel level.

In step S240, the discharge reference voltage applied to pixel driving circuits in the partition is regulated to the preset value.

Specifically, in step S210, the OLED display panel is divided evenly. The OLED display panel is divided evenly into m*n partitions along a direction parallel to rows of the pixel units and a direction parallel to columns of the pixel units, wherein m and n are both natural numbers. The partitions do not interfere with one another, and all pixel driving circuits in each partition correspond to one discharge reference voltage Vref. The discharge reference voltages of each of the partitions are independent.

Taking a panel with a resolution of 1920*1080 as an example, if the panel is divided into 4×4 partitions, Vref6 corresponds to an area formed by four points (line271, col481), (line271, col960), (line540, col481) and (line540, col960).

Figure 3:
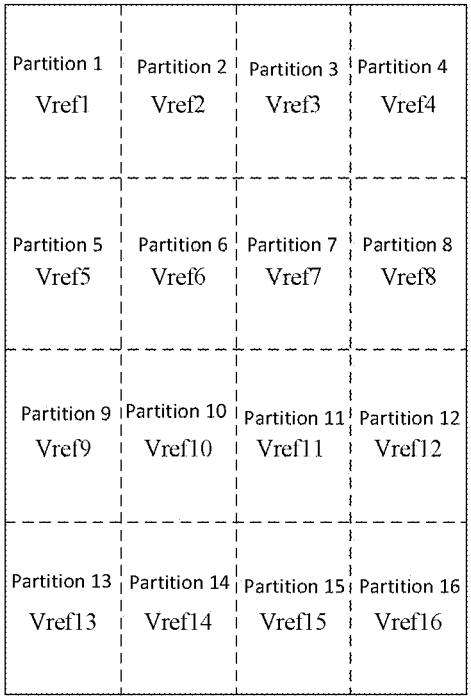
FIG. 3 is a schematic diagram of partitioning an OLED display panel.

Further, as shown in FIG. 3, the OLED display panel is divided evenly into 4*4 partitions, i.e. partition 1, partition 2, . . . partition 15 and partition 16, respectively. Each partition corresponds to one Vref. That is, there are 16 Vrefs corresponding to the aforesaid partitions respectively. The discharge reference voltages are respectively recorded as Vref1, Vref2, . . . Vref15 and Vref16, and these Vrefs corresponding to the partitions are unrelated to one another in the OLED panel.

Next, in step S220, an Average Pixel Level (APL) for each partition is calculated respectively. In this embodiment, the average pixel level refers to an average value of gray scale values of pixel units in one partition displayed for one frame of display image.

For example, partition 1 further contains 3*2 pixel units, the gray scale values of which are 60, 80, 130, 90, 88 and 200, respectively. The gray scale values above are summed and the average value is obtained as (60+80+130+90+86+200)/6=108. That is, the average pixel level of partition 1 is 108. According to the above method, the average pixel levels of other partitions can also be obtained.

In step S230, a preset value of a discharge reference voltage corresponding to each average pixel level (partition) is determined by a power management module.

For example, it is assumed that as to the above 16 partitions, their average pixel levels are recorded as P1, P2, . . . P15 and P16, respectively. Based on the above values, the preset values of the discharge reference voltages corresponding thereto are determined as Vref1, Vref2, . . . Vref15 and Vref16, respectively. The power management module determines the relationship between the average pixel levels and the preset values of the discharge reference voltages based on a preset conversion model or by looking up a table. In general, the higher the average pixel level of a partition is, the larger the corresponding Vref is. On the contrary, the lower the average pixel level of a partition is, the smaller the corresponding Vref is.

In step S240, the preset value of the discharge reference voltage of each partition obtained in step S230 is applied to the pixel driving circuits of each partition of the OLED panel.

Figure 4:
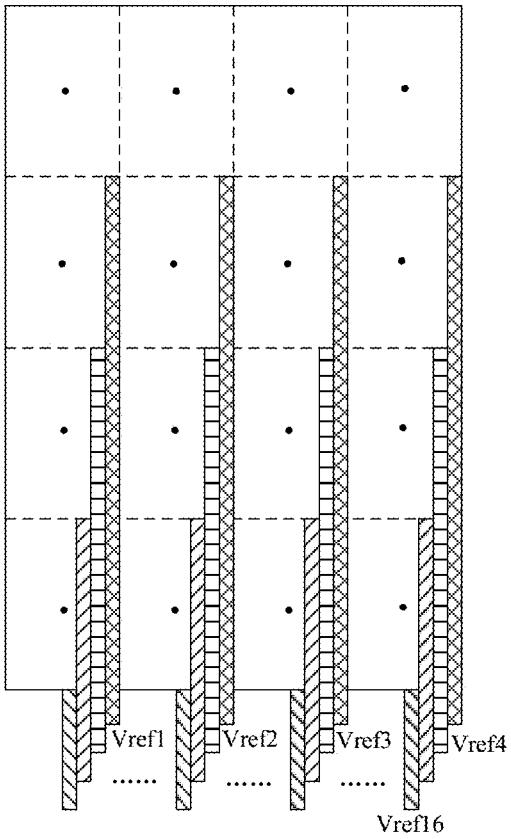
FIG. 4 is a schematic diagram of an input of a preset value of a discharge reference voltage of each partition.
Figure 5:
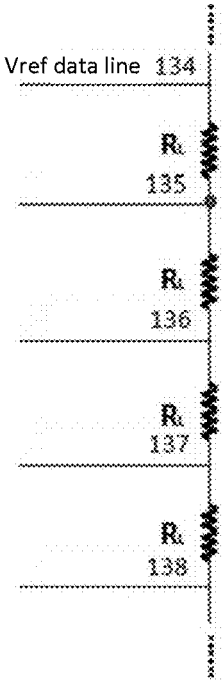
FIG. 5 is a schematic diagram of a circuit model of the discharge reference voltage.

The preset value of the discharge reference voltage is input according to a mode as shown in FIG. 4. It should be noted that, due to the panel manufacturing process, there will be an equal equivalent resistance RLine or RCol between each two lines or columns. That is, in reality, the preset value of the respective discharge reference voltage in the same partition is not a constant value. A reference circuit model of Vref is shown in FIG. 5, and there is a resistor $R_L$ between the Vref data line in row 134 and the Vref data line in row 135. In general, the preset value Vref determined by the average pixel level of the partition is input to a wiring provided at a pixel unit located at a center of each partition.

Figure 6:
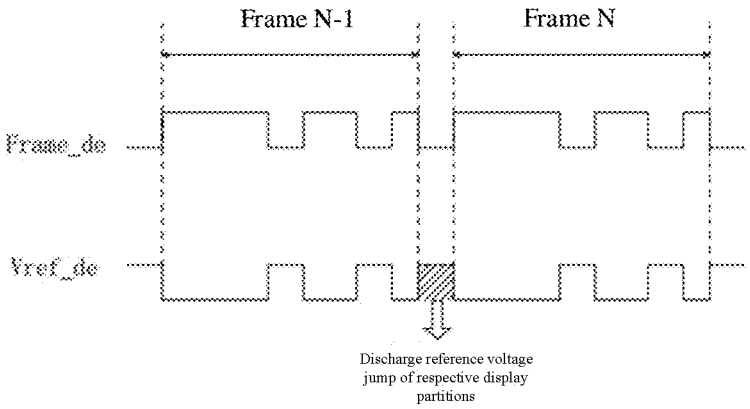
FIG. 6 is a schematic diagram of a timing sequence for regulating the discharge reference voltage.

The preset value of the discharge reference voltage is regulated before switching from a display image of a current frame to the one frame of image to be displayed, and a driving timing sequence is shown in FIG. 6. The Vref jump of each partition of the current frame occurs after an enable signal (Frame_de) of a previous frame is blanked and before an enable signal of the current frame is active. When adjusting the preset value of the discharge reference voltage, the enable signal Vref_de should be at a high level, as shown in FIG. 6.

Figure 7A:
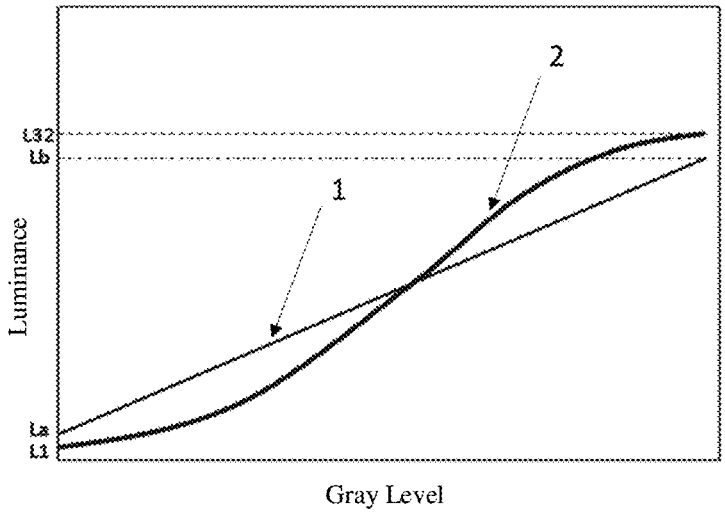
FIG. 7*a*-FIG. 7*c* are schematic diagrams of relationships between gray levels and luminance.

The driving method in the embodiment of the present disclosure can improve the contrast of an OLED display image, as described below. For the OLED display device driven in the PWM mode, when the Vref of an entire display driving circuit is a certain value, a relationship between gray level and luminance of a display image is shown in FIG. 7*a*. As shown by line 1 in FIG. 7*a*, a contrast of the image at this time can be calculated according to an equation: Contrast=Lb/La.

In the embodiment of the present disclosure, the OLED display panel is partitioned so that one frame of image has a plurality of different Vrefs during display. When a value of Vref changes, the relationship curve between the gray level and the luminance will change accordingly.

Figure 7B:
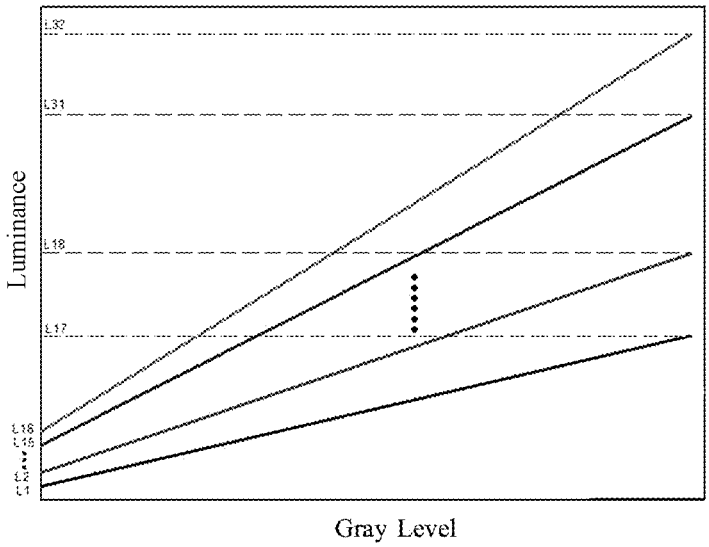

Still taking the previous example for explanation, it is assumed that a relationship among a third longitudinal partition Vref3, Vref7, Vref11 and Vref15 is Vref15>Vref3>Vref7>Vref11 (Vrefs are all negative values) and a relationship among a third horizontal partition Vref9, Vref10, Vref11 and Vref12 is Vref12>Vref9>Vref10>Vref11. It is further assumed that a relationship among Vref1, Vref2, . . . Vref15 and Vref16 is Vref2>Vref4>Vref12>Vref15>Vref1>Vref9>Vref8>Vref5>Vref10>Vref6>Vref3>Vref16>Vref7>Vref11>Vref13>Vref14, then the relationships between the gray levels and different degrees of luminance of different Vrefs corresponding to 16 partitions of the display image are shown in FIG. 7*b*.

Figure 7C:
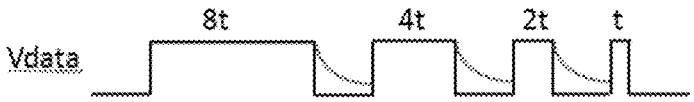

A discharge speed is controlled by regulating a value of Vref. When the value of Vref is high, the discharge of the storage capacitor is slow, and the case that discharge does not come to an end during the time period of blanking would possibly occur, as shown in FIG. 7*c*. At this time, the luminance of the image will be higher than that displayed in a traditional PWM drive mode, and otherwise it will be lower. Therefore, the relationship curve between the gray level and the luminance of a single partition will move up with the increase of Vref, and the relationship between the gray level and the luminance of the whole image is shown by curve 2 in FIG. 7*a*.

According to the calculation formula of contrast, it can be learned that Contrast=L32/L1. At this time, the contrast of the image is higher than that of any single curve, i.e. Contrast1=L17/L1, Contrast2=L18/L2, Contrast3=L19/L3, . . . Contrast16=L32/L16.

According to the driving method in the embodiment of the present disclosure, an OLED display panel is divided, and the discharge reference voltage Vref corresponding to each of the partitions is selected according to the average pixel level of the partition. Therefore, the contrast of the image can be regulated by changing the value of Vref so that the contrast of the image can be improved.

It should be noted that, the more the display image partitions, the more conducive to improvement the contrast of the image. However, the more the partitions (the greater the m*n), the higher the hardware cost. In practice, it is necessary to consider based on the display requirements. The examples provided in the above embodiments of the present disclosure are only used to illustrate the present disclosure and do not constitute a limitation on the present disclosure.

In the above-described embodiments, respective Vref values inside one partition are not completely equal, but the values are very close to one another. However, as to two adjacent partitions, since their Vref values are determined by the average pixel levels thereof, when the difference between the Vref values of the adjacent partitions is large while the difference between the gray levels at the edge of the divider line is small, a luminance divider line will appear on the displayed image.

In order to further improve the display quality between the partitions, in another embodiment of the present disclosure, after the step of determining, based on the average pixel level, a preset value of a discharge reference voltage corresponding to each partition and applied to each pixel driving circuit in the partition, the driving method further comprises a step of re-determining a preset value of the discharge reference voltage using a voltage compensation algorithm.

Specifically, when a difference between preset values Vrefs of discharge reference voltages of adjacent partitions determined according to the average pixel level is larger than a voltage threshold, it indicates that the difference between the image luminance of two adjacent partitions is large. Thus, in order to avoid a luminance mutation phenomenon between partitions, it is possible to smooth the luminance of the partitions, and appropriately reduce a higher preset value of the discharge reference voltage of some partitions, and it is also possible to appropriately increase a lower preset value of the discharge reference voltage of some other partitions, or to simultaneously employ two ways of regulation to compensate the voltage of Vref.

For example, it is assumed that the value of Vref1 of partition 1 is −1V, and the APL of the corresponding pixel units is 223; and the value of Vref2 of an adjacent partition 2 is −4V, and the APL of the corresponding pixel units is 31, it can be seen that, the difference of the display luminance between partition 1 and partition 2 is large. If there is a small difference between the gray levels at the boundary between partition 1 and partition 2, an apparent luminance divider line will appear between partition 1 and partition 2.

Further, it is assumed that the voltage threshold is 2V. By comparing the difference between Vref1 and Vref2 (−1V and −4V) and the voltage threshold, it can be obtained that the difference exceeds the voltage threshold. Therefore, the value of Vref1 can be appropriately reduced, or the value of Vref2 can be appropriately increased, or the value of Vref1 can be appropriately reduced and the value of Vref2 can be appropriately increased at the same time.

In the present embodiment, the Vref voltages of the adjacent partitions are compensated to avoid or mitigate the problem of a luminance divider line appearing on the display image, thereby improving a quality of the display image.

In another embodiment of the present disclosure, in order to further compensate the displayed image, after the step of calculating, based on the partitions, an average pixel level of one frame of image to be displayed corresponding to each partition, the driving method further comprises a step of re-calculating the average pixel level using an image compensation algorithm.

Specifically, comparing differences between average pixel levels of any two partitions, and when all or most of the differences between the average pixel levels of any two partitions are less than or equal to the first pixel level threshold, a part of pixel units (i.e., a first number of pixel units) with lower gray scale values can be selected from all pixel units, and the gray scale values of these pixel units can be appropriately reduced, or a portion of pixel units (i.e., a second number of pixel units) with higher gray scale values can be selected from all pixel units, and the gray scale values of these pixel units can be appropriately increased. After the above procedure, the pixel values of the input image can be compensated.

Further, the difference between the average pixel levels of two adjacent partitions can be further compared with a second pixel level threshold. When the difference between the average pixel levels of the two adjacent partitions is larger than the second pixel level threshold, a gray scale value of a pixel unit with a higher gray scale value at an edge of the two adjacent partitions is reduced, or a gray scale value of a pixel unit with a lower gray scale value at the edge of the two adjacent partitions is increased, or the gray scale value of the pixel unit with the higher gray scale value is reduced and the gray value of the pixel unit with the lower gray scale value is increased at the same time. After the above procedure, the luminance of the partitions can be smoothed to improve the display quality of the image.

In the present embodiment, the image compensation algorithm is used, so that the contrast of the display image can be further increased, and the quality of the display image can be improved.

Figure 8:
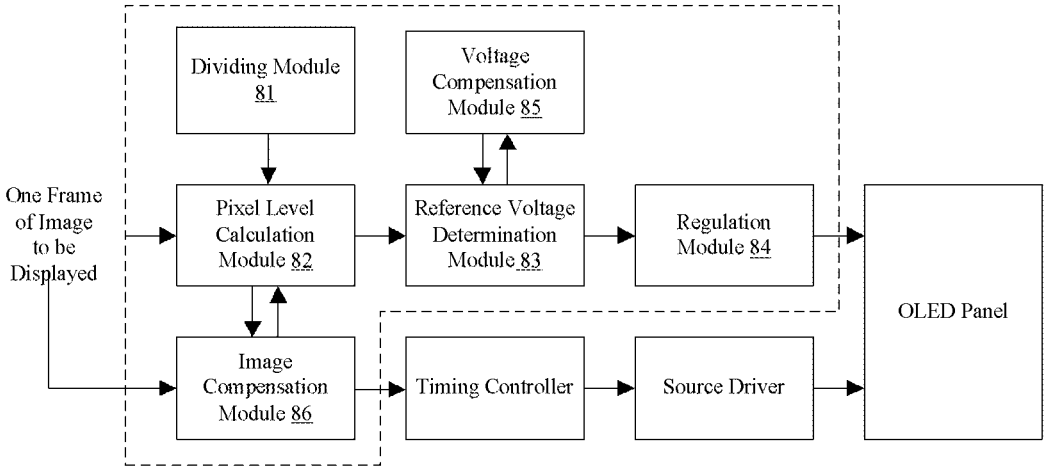
FIG. 8 is a structural diagram of a driving device for improving a contrast of an OLED image according to another embodiment of the present disclosure.

FIG. 8 is a structural diagram of a driving device for improving a contrast of an OLED image according to one embodiment of the present disclosure. As shown in FIG. 8, an upper driving branch shown by the dash box is the driving device according to the embodiment of the present disclosure, and the driving device specifically comprises:

a dividing module 81, configured to divide an OLED display panel into a plurality of partitions;

a pixel level calculation module 82, configured to calculate, based on the partitions, an average pixel level of one frame of image to be displayed corresponding to each partition;

a reference voltage determination module 83, configured to determine, based on the average pixel level, a preset value of a discharge reference voltage corresponding to each partition and applied to each pixel driving circuit in the partition; and a regulation module 84, configured to regulate the discharge reference voltage applied to pixel driving circuits in the partition to the preset value and output the preset value to an OLED panel.

The driving device further comprises a voltage compensation module 85. After the reference voltage determination module 83 determines the preset value of the discharge reference voltage corresponding to each partition and applied to each pixel driving circuit in the partition, the voltage compensation module 85 re-determines the preset value of the discharge reference voltage using a voltage compensation algorithm.

The driving device further comprises an image compensation module 86. After the pixel level calculation module 82 calculates an average pixel level of one frame of image to be displayed corresponding to each partition, the image compensation module 86 re-calculates the average pixel level using an image compensation algorithm.

In addition, an output signal of the image compensation module 86 is input into a timing controller T-Con, a source driver and the OLED panel in sequence to realize driving of the display panel.

The driving device in the embodiment of the present disclosure can improve the contrast of the display image and maintain an original quality of the image. When the luminance of the image shows a large horizontal or vertical step change, the contrast of the display image can be significantly improved.

Although the embodiments disclosed by the present disclosure are described as above, the described contents are merely implementation modes employed for the purpose of facilitating the understanding of the present disclosure, and are not intended to limit the present disclosure. Any person skilled in the technical field of the present disclosure could make any modification and variation in the implementation forms and details, without departing from the spirit and scope of the present disclosure, but the patent protection scope of the present disclosure still needs to be based on the scope as defined in the appended claims.

The invention claimed is:

1. A driving method for improving a contrast of an OLED image, comprising steps of:

dividing an OLED display panel into a plurality of partitions;

calculating, based on the partitions, an average pixel level of one frame of image to be displayed corresponding to each partition, wherein the average pixel level is an average value of gray scale values of pixel units in one partition;

determining, based on the average pixel level, a preset value of a discharge reference voltage corresponding to each partition and applied to each pixel driving circuit in the partition; and regulating the discharge reference voltage applied to pixel driving circuits in the partition to the preset value.

2. The driving method according to claim 1, wherein, after the step of determining, based on the average pixel level, a preset value of a discharge reference voltage corresponding to each partition and applied to each pixel driving circuit in the partition, the driving method further comprises a step of re-determining a preset value of the discharge reference voltage using a voltage compensation algorithm, specifically:

when a difference between preset values of discharge reference voltages of adjacent partitions determined according to the average pixel level is larger than a voltage threshold, reducing a higher preset value of the discharge reference voltage, and/or increasing a lower preset value of the discharge reference voltage.

3. The driving method according to claim 2, wherein, after the step of calculating, based on the partitions, an average pixel level of one frame of image to be displayed corresponding to each partition, the driving method further comprises a step of re-calculating the average pixel level using an image compensation algorithm:

comparing a difference between average pixel levels of any two partitions, when the difference is less than or equal to a first pixel level threshold, selecting pixel units with a lower gray scale value according to a first number of pixels, and respectively decreasing a gray scale value of each pixel unit; and selecting pixel units with a higher gray scale value according to a second number of pixels, and respectively increasing a gray scale value of each pixel unit.

4. The driving method according to claim 3, wherein the step of re-calculating the average pixel level using an image compensation algorithm further comprises:

comparing a difference between average pixel levels of two adjacent partitions, when the difference is larger than a second pixel level threshold, decreasing a gray scale value of a pixel unit with a higher gray scale value at an edge of the two adjacent partitions; and/or increasing a gray scale value of a pixel unit with a lower gray scale value at the edge of the two adjacent partitions.

5. The driving method according to claim 1, wherein the discharge reference voltage applied to pixel driving circuits in the partition is regulated to the preset value before switching from a display image of a current frame to the one frame of image to be displayed.

6. The driving method according to claim 5, wherein the step of dividing an OLED display panel into a plurality of partitions comprises:

dividing the OLED display panel evenly into m*n partitions along a direction parallel to rows of the pixel units and a direction parallel to columns of the pixel units, wherein m and n are both natural numbers.

7. A driving device for improving a contrast of an OLED image, comprising:

a dividing module, configured to divide an OLED display panel into a plurality of partitions;

a pixel level calculation module, configured to calculate, based on the partitions, an average pixel level of one frame of image to be displayed corresponding to each partition, wherein the average pixel level is an average value of gray scale values of pixel units in one partition;

a reference voltage determination module, configured to determine, based on the average pixel level, a preset value of a discharge reference voltage corresponding to each partition and applied to each pixel driving circuit in the partition; and a regulation module, configured to regulate the discharge reference voltage applied to pixel driving circuits in the partition to the preset value.

8. The driving device according to claim 7, further comprising a voltage compensation module which is configured to, after the reference voltage determination module determines a preset value of a discharge reference voltage corresponding to each partition and applied to each pixel driving circuit in the partition, re-determine a preset value of the discharge reference voltage using a voltage compensation algorithm:

the voltage compensation module is specifically configured to, when a difference between preset values of discharge reference voltages of adjacent partitions determined according to the average pixel level is larger than a voltage threshold, reduce a higher preset value of the discharge reference voltage, and/or increase a lower preset value of the discharge reference voltage.

9. The driving device according to claim 8, further comprising an image compensation module which is configured to compare a difference between average pixel levels of any two partitions:

when the difference is less than or equal to a first pixel level threshold, selecting pixel units with a lower gray scale value according to a first number of pixels, and respectively decreasing a gray scale value of each pixel unit; and selecting pixel units with a higher gray scale value according to a second number of pixels, and respectively increasing a gray scale value of each pixel unit.

10. The driving device according to claim 9, wherein the image compensation module compares a difference between average pixel levels of two adjacent partitions:

when the difference is larger than a second pixel level threshold, decreasing a gray scale value of a pixel unit with a higher gray scale value at an edge of the two adjacent partitions; and/or increasing a gray scale value of a pixel unit with a lower gray scale value at the edge of the two adjacent partitions.

* * * * *